US007796102B2

(12) United States Patent
Ishizuka et al.

(10) Patent No.: US 7,796,102 B2
(45) Date of Patent: Sep. 14, 2010

(54) ACTIVE MATRIX TYPE DISPLAY DEVICE

(75) Inventors: Atsuo Ishizuka, Kanagawa (JP); Hisashi Yamaguchi, Kanagawa (JP); Yasunobu Hashimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 692 days.

(21) Appl. No.: 11/587,905

(22) PCT Filed: Apr. 30, 2004

(86) PCT No.: PCT/JP2004/006352

§ 371 (c)(1),
(2), (4) Date: Aug. 22, 2007

(87) PCT Pub. No.: WO2005/106834

PCT Pub. Date: Nov. 10, 2005

(65) Prior Publication Data

US 2008/0143648 A1 Jun. 19, 2008

(51) Int. Cl.
*G09G 3/32* (2006.01)

(52) U.S. Cl. ..... 345/82; 345/76; 345/204; 345/211; 315/169.1; 315/169.3; 315/169.4

(58) Field of Classification Search ..... 345/76–82, 345/204, 211–214; 315/169.1, 169.3, 169.4; 313/500, 504, 506
See application file for complete search history.

(56) References Cited

U.S. PATENT DOCUMENTS 6,229,506 B1 * 5/2001 Dawson et al. ..... 345/82
6,373,454 B1 4/2002 Knapp et al.
6,583,775 B1 6/2003 Sekiya et al.

(Continued)

FOREIGN PATENT DOCUMENTS

JP 8-234683 A 9/1996

(Continued)

OTHER PUBLICATIONS

Ton Van De Biggelaar et al., SPIE, 2001, PLED, final.

(Continued)

*Primary Examiner*—Henry N Tran
(74) *Attorney, Agent, or Firm*—Birch Stewart Kolasch & Birch LLP

(57) ABSTRACT

The display device of the invention comprises a plurality of scanning lines (Wscan and Escan) which are selected successively, a plurality of data lines (Data) to which the writing electric current (Idata) in accordance with brightness information is supplied according to the scanning line selection, and a plurality of pixels (PX) arranged at intersecting points between the scanning lines and the data lines. Each of the pixels comprises a light emitting element (OLED), a driving transistor (TFT4), a capacitor (C) connected to the gate (Nd) of the driving transistor for accumulating writing data, a first transistor (TFT1) which is turned on during writing period in which the scanning lines are scanned and which connects the data lines and the drain of the driving transistor, and a second transistor (TFT2) which is turned on during the writing period and which short-circuits the gate and drain of the driving transistor. With such a structure, the light emitting element can be driven with a driving electric current equivalent to the writing electric current, irrespective of variations in characteristics of the transistors.

6 Claims, 10 Drawing Sheets

U.S. PATENT DOCUMENTS

| | | | | |
|---|---|---|---|---|
| 7,154,454 | B2 * | 12/2006 | Okabe et al. | 345/76 |
| 7,164,401 | B2 * | 1/2007 | Kwon | 345/82 |
| 7,612,745 | B2 * | 11/2009 | Yumoto et al. | 345/76 |
| 7,649,515 | B2 * | 1/2010 | Ozawa et al. | 345/82 |
| 2003/0197473 | A1 | 10/2003 | Kitahara | |

FOREIGN PATENT DOCUMENTS

| | | | |
|---|---|---|---|
| JP | 2001-60076 | A | 3/2001 |
| JP | 2001-147659 | A | 5/2001 |
| JP | 2002-514320 | A | 5/2002 |
| JP | 2002-517806 | A | 6/2002 |
| JP | 2003-150118 | A | 5/2003 |
| JP | 2004-69816 | A | 3/2004 |
| TW | 571273 | B | 1/2004 |
| TW | 571281 | B | 1/2004 |
| TW | 584824 | B | 4/2004 |
| WO | WO-01/06484 | A1 | 1/2001 |

OTHER PUBLICATIONS

Yumoto et al., Asia Display/IDW 2001, OEL 1-1, pp. 1395-1398.

* cited by examiner

CONVENTIONAL EXAMPLE

CONVENTIONAL EXAMPLE

CONVENTIONAL EXAMPLE

| | tW WRITING PERIOD | tR READING PERIOD | tE ELIMINATION PERIOD |
|---|---|---|---|
| Wscan | HIGH | LOW | LOW |
| Escan | HIGH | LOW | HIGH |
| TFT1 | ON | OFF | OFF |
| TFT2 | ON | OFF | ON |
| TFT3 | OFF | ON | OFF |
| TFT4 | FOLLOWING THE I-V CHARACTERISTIC | FOLLOWING THE I-V CHARACTERISTIC | FOLLOWING THE I-V CHARACTERISTIC |

DUIRNG WRITING OPERATION

DURING READING OPERATION

DUIRNG WRITING OPERATION

DURING READING OPERATION

ACTIVE MATRIX TYPE DISPLAY DEVICE

BACKGROUND OF THE INVENTION

1. Field of the Invention

The present invention relates to a display device in which light emitting elements, such as organic electroluminescence (EL) elements whose luminescent brightness is controlled by electric current, are provided per pixel, and particularly to an active matrix type display device in which the quantity of electric current to be supplied to each light emitting element is controlled by an active element such as a field effect transistor and which can reproduce the display brightness irrespective of variations in characteristics of the active element.

2. Background Art

An organic EL display device is a self-emission type display device in which an organic EL element that serves as a light emitting element is provided per pixel, and it has advantages such as high visibility of images, no need for a back light, and fast response speed, as compared with a liquid crystal display device. Further, since the luminescence brightness of the organic EL element is controlled by the value of the driving electric current, it is necessary that an electric current having a magnitude corresponding to the brightness information be applied to the organic EL elements for respective pixels.

Meanwhile, the driving system of the organic EL display device includes a simple matrix type and an active matrix type. The former type is simple in structure, but makes it difficult to achieve a large screen and high image resolution since it emits light only for a scanning period, and the latter type, i.e., the active matrix type, is more advantageous for achieving a large screen and high-resolution of an image. In the active matrix type, the current to be applied light emitting elements provided per pixel is controlled by an active element such as a transistor in the pixel. In the case of the organic EL display device, such an active element is realized by a thin film transistor (TFT: Thin Film Transistor).

FIG. 1 is a schematic structural view of a conventional active matrix type organic EL display device. In an organic EL panel 10 are provided a plurality of horizontal scanning lines Scan 1 to N, a plurality of vertical data lines Data 1 to M, and matrix-like pixels PX arranged at intersecting points therebetween. A scanning line driving circuit 14 scans successively the scanning lines Scan 1 to N within a frame period, and a data line driving circuit 12 supplies electric current corresponding to the brightness information to the pixels through the data lines Data during each scanning period.

FIG. 2 is a view showing an example of a pixel circuit of a conventional organic EL element. The pixel circuit is described in Japanese Patent Application Laid-Open (JP-A) No. 8-234683 (hereinafter, referred to as Patent Document No. 1). Further, an analogous pixel circuit is described in "Passive and active matrix addressed polymer light emitting diode displays", SPIE2001, PLED, final (hereinafter, referred to as Non-Patent Document No. 1).

This pixel circuit comprises an N-channel transistor TFT1, which is on-off controlled by a scanning line Scan, a P-channel transistor TFT2 for driving an organic EL element OLED, and a storage capacitor C provided between the gate of the transistor TFT2 and a power source Vdd.

The operation of the pixel circuit is carried out as described below. When the transistor TFT1 is turned on with the scanning line Scan in selected state so that a data potential Vdata corresponding to the brightness information is applied to the data line Data, the capacitor C is charged or discharged through the transistor TFT1, and a potential corresponding to the data potential Vdata is accumulated at the gate node Nd of the transistor TFT2. Thereafter, when the transistor TFT 1 is turned off with the scanning line Scan in non-selected state, the transistor TFT2 flows a drain-source current Ids2 corresponding to the potential at the gate node Nd so that the light emitting element OLED emits light with brightness corresponding to the drain-source current Ids2. The drain-source current Ids2 depends on the gate-source voltage Vgs of the transistor TFT2 (=the potential at the gate node Nd−voltage at the OLED). Meanwhile, the transistor TFT2 is operated in a saturated region, so that the drain-source current Ids2 is controlled only by the gate-source voltage Vgs even if unevenness is caused to occur in the Vds of the transistor TFT2 due to the unevenness in characteristic of the light emitting element OLED.

Through use of the pixel circuit described above, as shown in FIG. 1, brightness information can be written by charging or discharging the capacitor C for each pixel in the scanning period and the light emitting element for each pixel is operated according to the written information, during the subsequent read-out period. Consequently, the driving current of the light emitting element can be decreased by prolonging the light emission period of the light emitting element, and thus it is possible to achieve a display device having a large screen and high resolution.

In the pixel circuit shown in FIG. 2, there is a problem of variation of brightness among pixels attributed to the variation in the characteristics of TFT formed on display panel. The TFT is formed on a substrate such as glass, and due to the production variations, the threshold voltage of TFT and carrier mobility vary, and correspondingly, the drain-source current Ids2 of the transistor TFT2 also vary. Due to the unevenness of the drain-source current Ids2, which is the driving current, the luminescence brightness of the light emitting element OLED becomes uneven.

In order to make luminescence brightness independent of the characteristic unevenness of TFT such as described above, a pixel circuit shown in FIG. 3 has been proposed, which, for example, is disclosed in JP-A No. 2001-147659 (hereinafter, referred to as Patent Document No. 2) and "Pixel-Driving Methods for Large-Sized Poly-Si AM-OLED Displays" Asia Display/IDW 2001, OEL 1-1, p 1395 (hereinafter, referred to as Non-Patent Document No. 2). The pixel circuit comprises a transistor TFT3 controlled by a scanning line ScanA, a transistor TFT4 controlled by a scanning line ScanB, transistors TFT1 and TFT2 with their gates connected in common, a capacitor provided between a common gate Nd and a constant voltage terminal Vdd and a light emitting element OLED is current operated by the transistor TFT2.

According to the description in the above-mentioned Patent Document No. 2, the operation of the pixel circuit shown in FIG. 3 is like this. When brightness information is written, the transistor TFT3 is turned on with the scanning line ScanA in the selected state (H level), and the transistor TFT4 is also turned on with the scanning line ScanB in the selected state (L level), so that the electric current Idata corresponding to the brightness is caused to flow through the data line and thus the current Iw corresponding to the brightness is passed to the transistor TFT1. The transistor TFT1 is in a saturated state due to the drain-gate thereof being short-circuited by the transistor TFT4, and a current mirror circuit is formed. The capacitor C is charged by the drain source current Iw and a potential corresponding to the brightness information is written in the node Nd. On the other hand, at the time of reading out, both scanning lines ScanA and ScanB are in non-selected state and both of the transistors TFT3 and TFT4 are turned off. At this time, the transistor TFT2 supplies drain-source electric current Ids2 corresponding to the gate potential to the light emitting element OLED and causes it to emit light. The drain-source electric current Ids2 has a relation with the electric current Iw corresponding to the brightness information such that the current value corresponds to a ratio of the gate width and the gate length of the transistors TFT1 and TFT2. Thus, the light emitting element OLED can be operated with the driving current Ids2 corresponding to the electric current Iw at the time of writing, causing the light emitting element OLED to emit light with luminescence brightness corresponding to the brightness information.

DISCLOSURE OF THE INVENTION

However, the pixel circuit shown in FIG. 3 is based on the assumption that no variations in threshold voltages exists between the transistors TFT1 and TFT2 in the pixels. However, in the case where the transistors TFT1 and TFT2 are formed adjacently to each other in the same pixel, if the threshold voltages of the transistors TFT1 and TFT2 vary for one reason or another, even when the same gate-source voltage Vgs is maintained between both transistors by the potential at the common gate Nd, the drain-source current Iw and Ids2 do not reflect the transistor size ratios and variations of the threshold voltages affect the driving current Ids2.

Further, when the threshold voltages Vth1 and Vth2 of the transistors TFT1 and TFT2 become such that Vth1>Vth2, even if the current Iw is set to be zero for black display, the gate-source voltage Vgs becomes higher than Vth2 and electric current flows between the source and the drain of the transistor TFT2, thus making black display impossible. Further, on the contrary, in the case of Vth1<Vth2, despite setting the electric current Iw for an extremely slight light emission to be a very low value, the gate-source voltage Vgs becomes smaller than Vth2 and no electric current flows between the source and the grain of the transistor TFT2, thus resulting in black display. Due to such a phenomena, in the case where the relation between the threshold voltages Vth1 and Vth2 of both of the transistors TFT1 and TFT2 differs per pixel, the light emission state of each pixel varies so that the image quality is decreased.

Therefore, it is an object of the invention to provide an active matrix type display device in which the image quality can be prevented from being decreased due to unevenness in characteristics of active elements.

It is another object of the invention to provide an active matrix type organic EL display device in which the image quality is prevented from being decreased due to unevenness in characteristics of transistors in each pixel.

A first aspect of the invention is a display device including a plurality of scanning lines arranged in a first direction and which are selected successively, a plurality of data lines arranged in the direction intersecting the first direction and to which a writing electric current corresponding to brightness information is supplied according to the scanning line selection, and a plurality of pixels arranged at the intersecting points between the plurality of scanning lines and the plurality of data lines. Wherein each of the pixels includes a light emitting element, a driving transistor for supplying a driving current to the light emitting element, a capacitor connected to the gate of the driving transistor for storing writing data, a first transistor that is turned on during a writing period in which the scanning lines are scanned and connects the data lines and the drain of the driving transistor, and a second transistor that is turned on during a writing period and short-circuits the gate and drain of the driving transistor while at the same time supplying the writing electric current supplied from the data lines to the capacitor. During the writing period, the writing electric current is supplied to a circuit including the first transistor and the driving transistor in which the gate-drain of the first transistor is short-circuited so that the capacitor is charged so as to cause the gate of the driving transistor to have a gate potential corresponding to the writing electric current; and during the reading period after the writing period, the first and second transistors are turned off so that the driving transistor drives the light emitting element with a driving electric current corresponding to the gate potential.

According to the first aspect, the light emitting element can be driven with the driving electric current equal to the writing electric current, irrespective of unevenness in characteristics of the driving transistor.

In a preferred embodiment of the first aspect, during a elimination period before the writing period and after the reading period, the second transistor is turned on so that the electric charge of the capacitor is discharged to the light emitting element through the driving transistor.

Since the capacitor is reset during the elimination period, the state of the prior frame does not affect the current frame and the effect of the afterimage of the image of the prior frame in a motion display on the image in the present frame can be suppressed. Further, the brightness of the image overall can be controlled by controlling the elimination period.

BEST MODE FOR CARRYING OUT THE INVENTION

Hereinafter, embodiments of the invention will be described with reference to the drawings.

Figure 1:
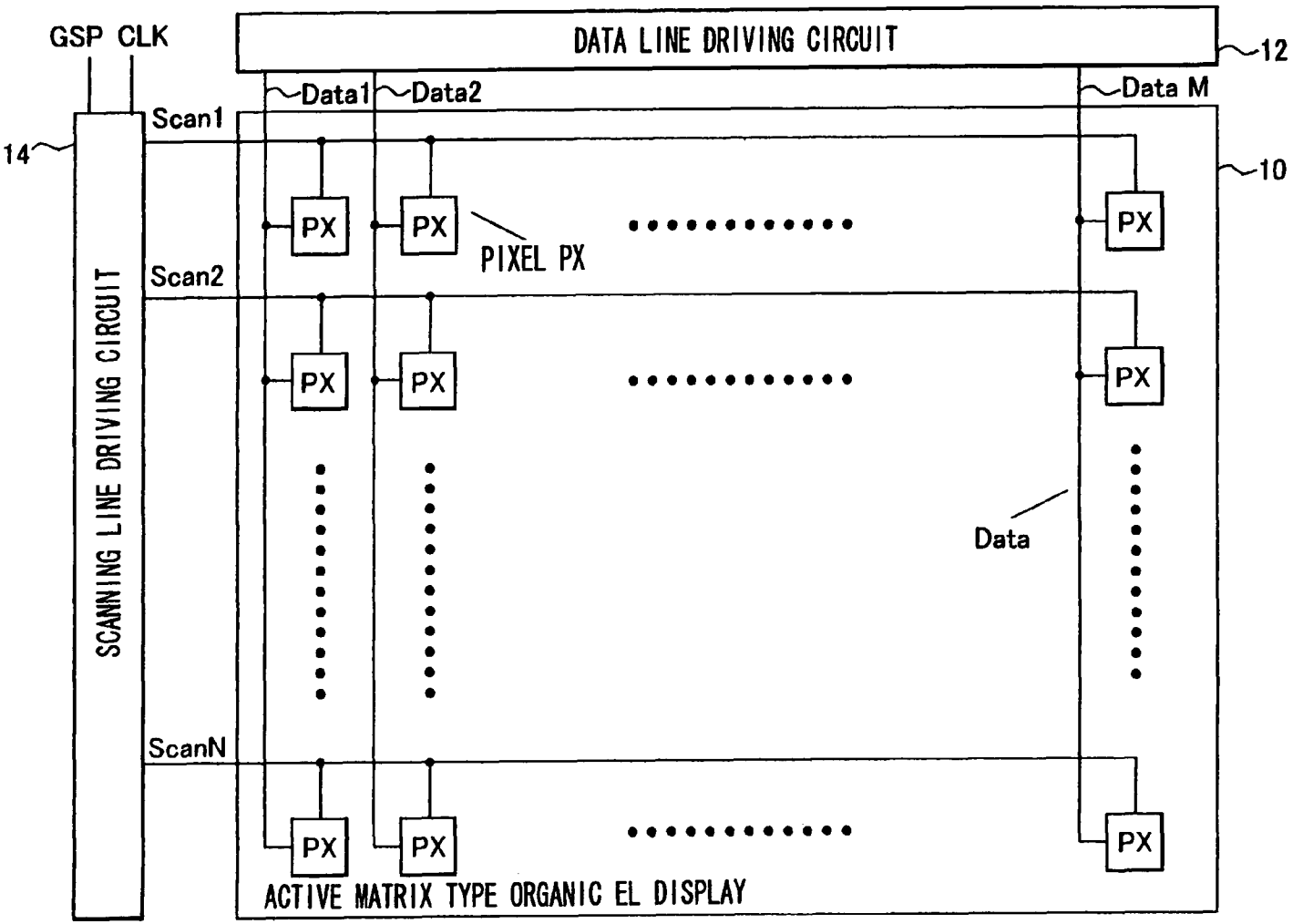
FIG. 1 is a schematic structure of a conventional active matrix type organic EL display device.
Figure 2:
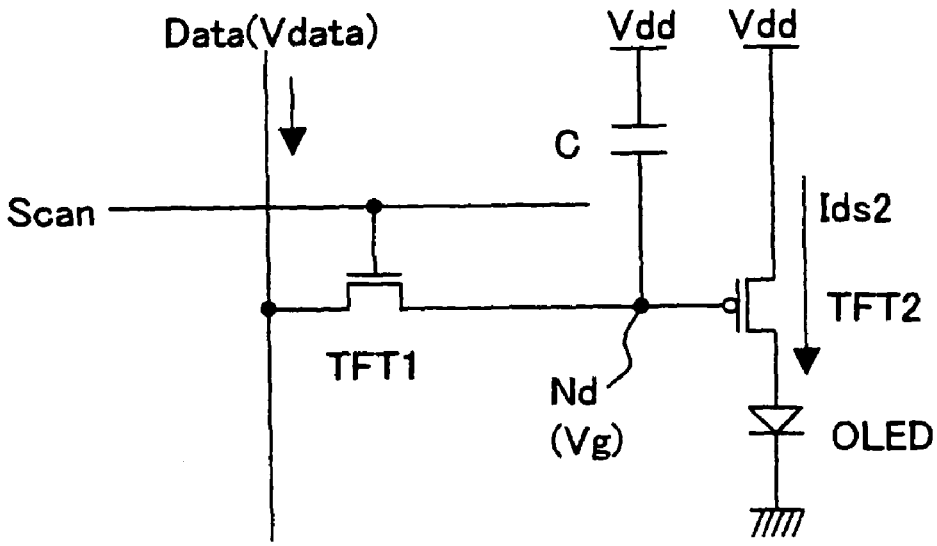
FIG. 2 is a view showing an example of a pixel circuit of a conventional organic EL element.
Figure 3:
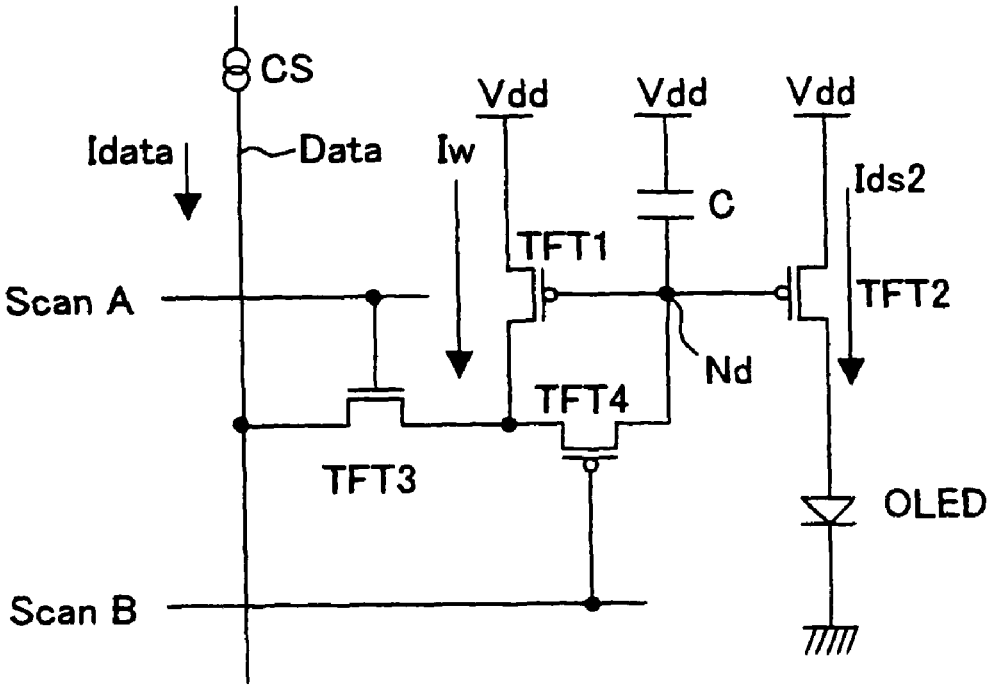
FIG. 3 is a view showing an example of a pixel circuit of a conventional organic EL element.
Figure 4:
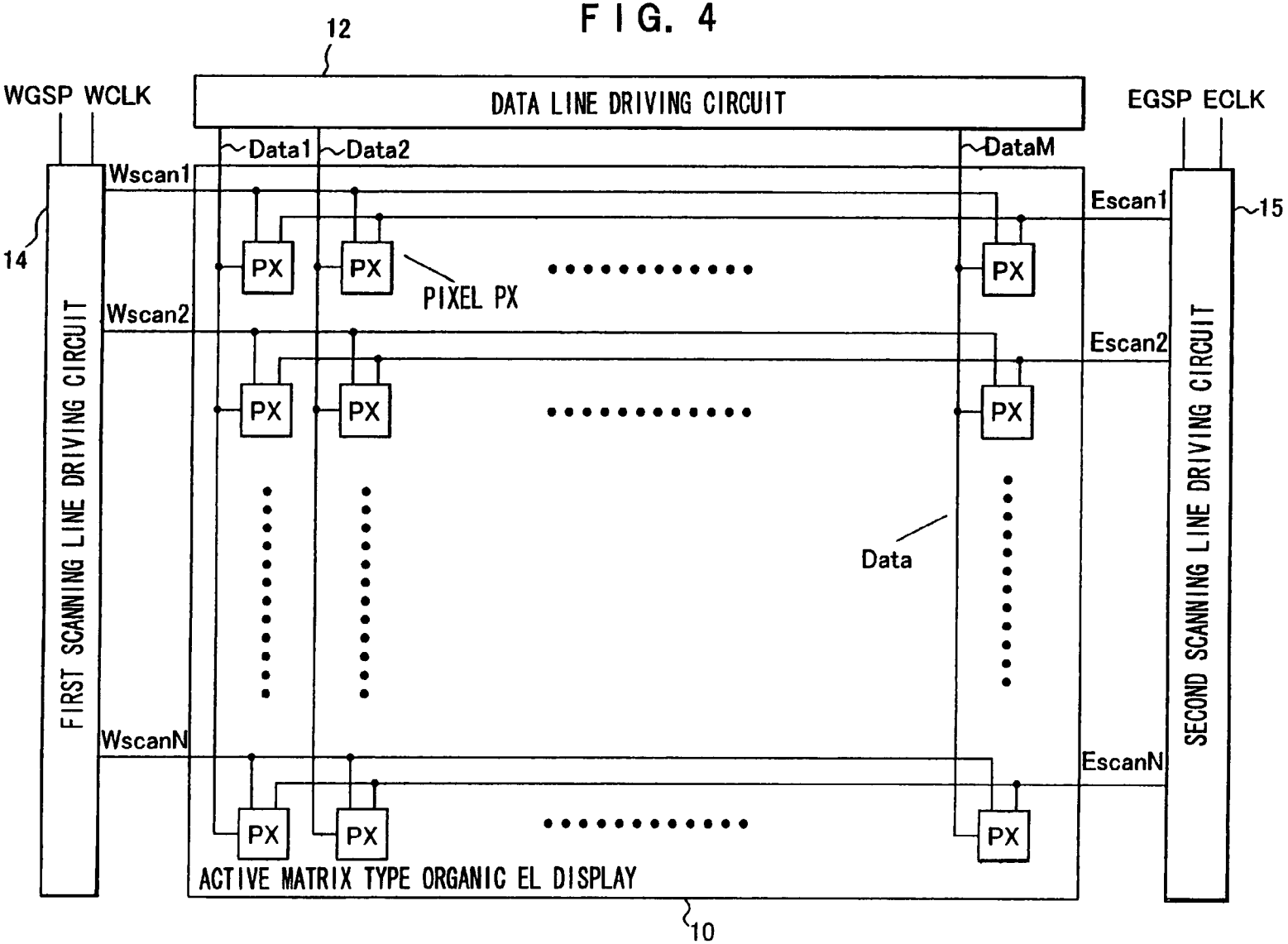
FIG. 4 is a schematic structural view of an active matrix type display device in an embodiment of the present invention.

FIG. 4 is a schematic structural view of an active matrix type display device in an embodiment of the invention. The display device, for example, is an organic EL display device using organic EL elements. In the display device shown in FIG. 4, an organic EL panel 10 includes: plural horizontal first scanning lines Wscan 1 to N and plural horizontal second scanning lines Escan 1 to N,; plural vertical data lines Data 1 to M; and a matrix of pixels PX disposed at the intersecting points therebetween. The scanning lines Wscan 1 to N are successively scanned by a first scanning line driving circuit 14 and the second scanning lines Escan 1 to N are successively scanned by a second scanning line driving circuit 15 within a frame period and a data line driving circuit 12 supplies an electric current corresponding to the brightness information to the data lines Data 1 to M during each scanning period.

Figure 5:
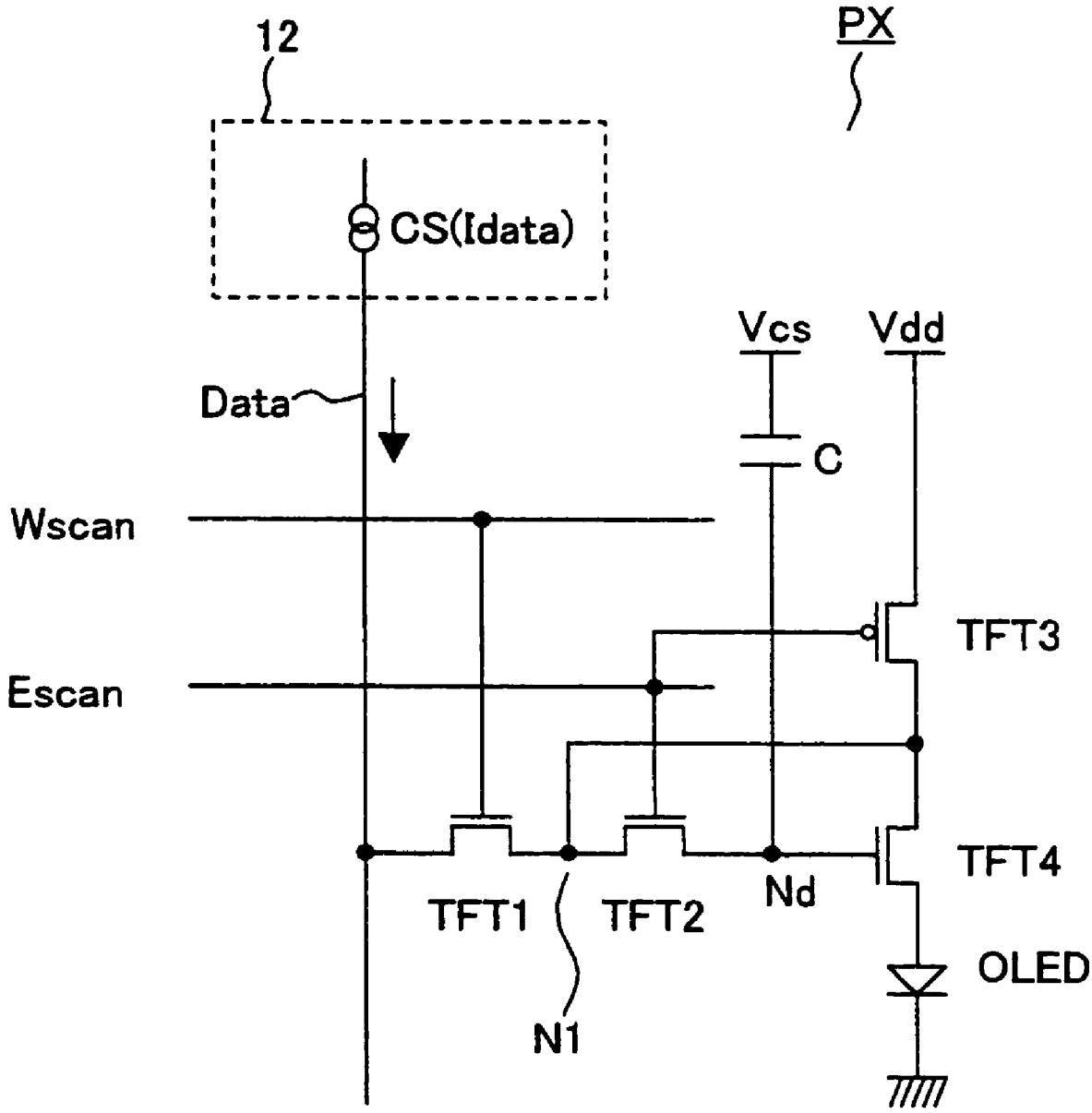
FIG. 5 is a view showing a pixel circuit of a display device in an embodiment of the invention.

FIG. 5 is a view showing a pixel circuit of a display device in an embodiment of the invention. The pixel PX comprises: a light emitting element OLED such as an organic EL element for emitting light with brightness corresponding to the driving electric current; a driving transistor TFT4 for supplying the driving electric current to the light emitting element OLED; a third transistor TFT3 for connecting the drain of the driving transistor TFT4 to an electric power source Vdd; a first transistor TFT1 whose gate is connected with the first scanning line Wscan; a second transistor TFT2 whose gate is connected with the second scanning line Escan; and a capacitor C formed between the gate node Nd of the driving transistor TFT4 and a predetermined voltage source Vcs. Only the third transistor TFT3 is a p-channel transistor and the other transistors are n-channel transistors. Accordingly, the transistors TFT2 and TFT3 driven by the same second scanning line Escan are on-off controlled with opposite polarity.

The voltage source Vcs for the capacitor C may be the power source Vdd. Further, MOS capacitance may be used for the capacitor C. Further, in the case where an organic EL element is used for the light emitting element OLED, the cathode thereof is grounded and the anode thereof is connected to the driving transistor TFT4. The third transistor TFT3 may be an n-channel transistor, and in such a case, the gate is controlled by the third scanning line (not illustrated) driven with opposite polarity to that of the second scanning line Escan.

The data line driving circuit 12 comprises an electric current source CS for supplying a writing electric current Idata corresponding to the brightness information to the data line Data. The electric current Idata of the electric current source CS is controlled to be the electric current value corresponding to the gradation value of the display brightness of the pixel.

Figure 6:
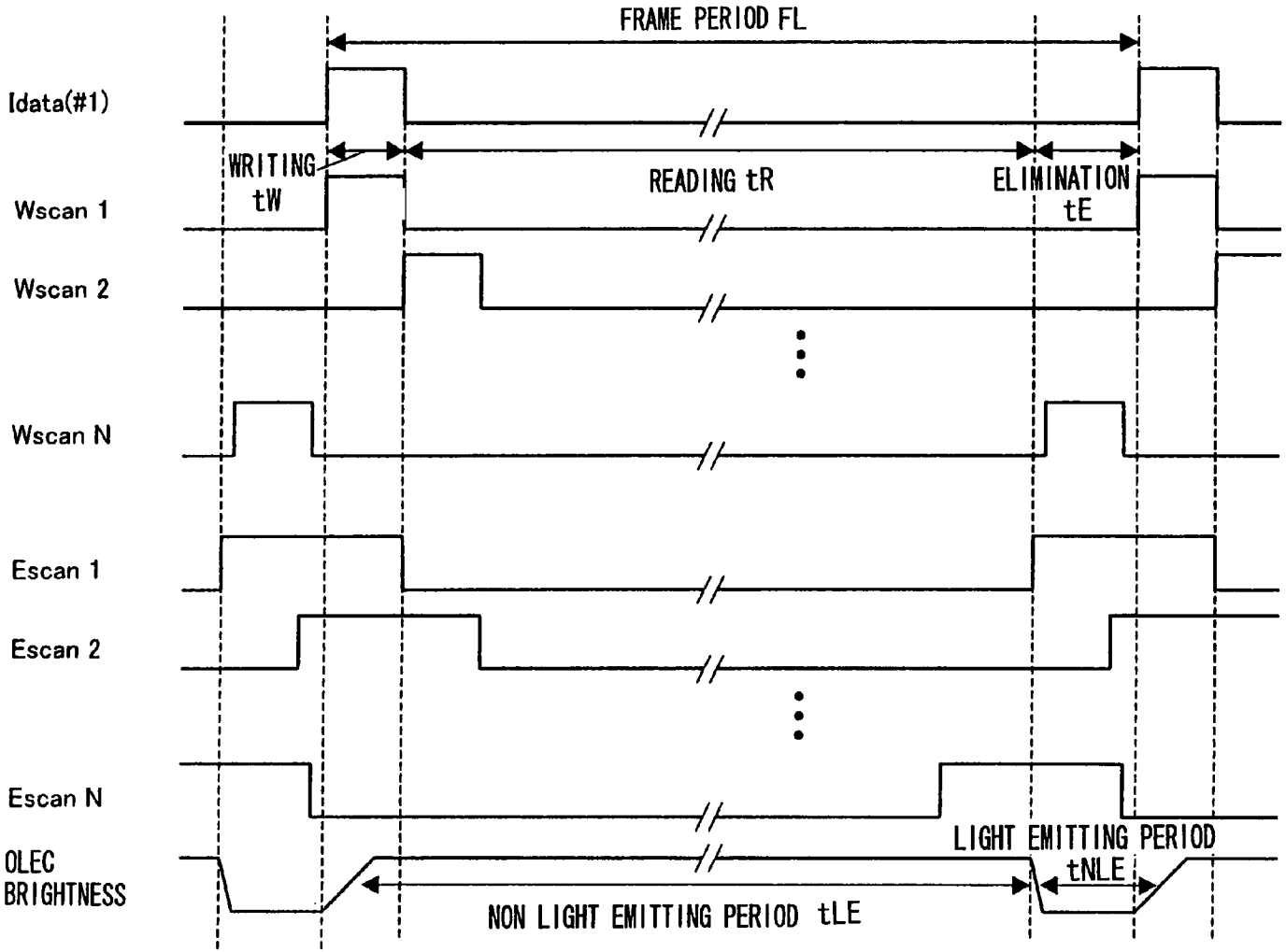
FIG. 6 shows an operation waveform view of the display device shown in FIG. 4 and FIG. 5.

FIG. 6 is an operating waveform view of the display device shown in FIG. 4 and FIG. 5. FIG. 6 shows the writing electric current Idata corresponding to the brightness information to be supplied to the data line Data, the driving pulse waveform of the first scanning lines Wscan 1 to N, the driving pulse waveform of the second scanning lines Escan 1 to N, and light emmission waveform of the light emitting element OLED. During one frame period FL, the driving pulses are successively supplied to the first scanning lines Wscan 1 to N so as to turn on the first transistor TFT 1 in the corresponding pixel. Further, the driving pulses are successively supplied to the second scanning lines Escan 1 to N so as to turn on the second transistor TFT2 in the corresponding pixel. The driving pulses to the second scanning line Escan has an earlier leading edge than the driving pulses to the first scanning line Wscan and decays at nearly the same timing as the driving pulses to the first scanning line Wscan. Thus, the second transistor TFT2 is turned on first, and subsequently the first and second transistors TFT 1 and TFT2 are both turned on for a period and then turned off at the same time. The third transistor TFT3, which is a p-channel transistor, is turned on during the time the second scanning line Escan is at the L level and is electrically disconnected during the time when the second scanning line Escan is at the H level.

FIG. 6 shows the writing period tW, the reading period tR, and the elimination period tE for the pixel to be connected to the first scanning line Wscan 1. Further, the light emitting period tLe and non light emitting period tNLE for the light emitting element OLED are shown.

Figure 7:
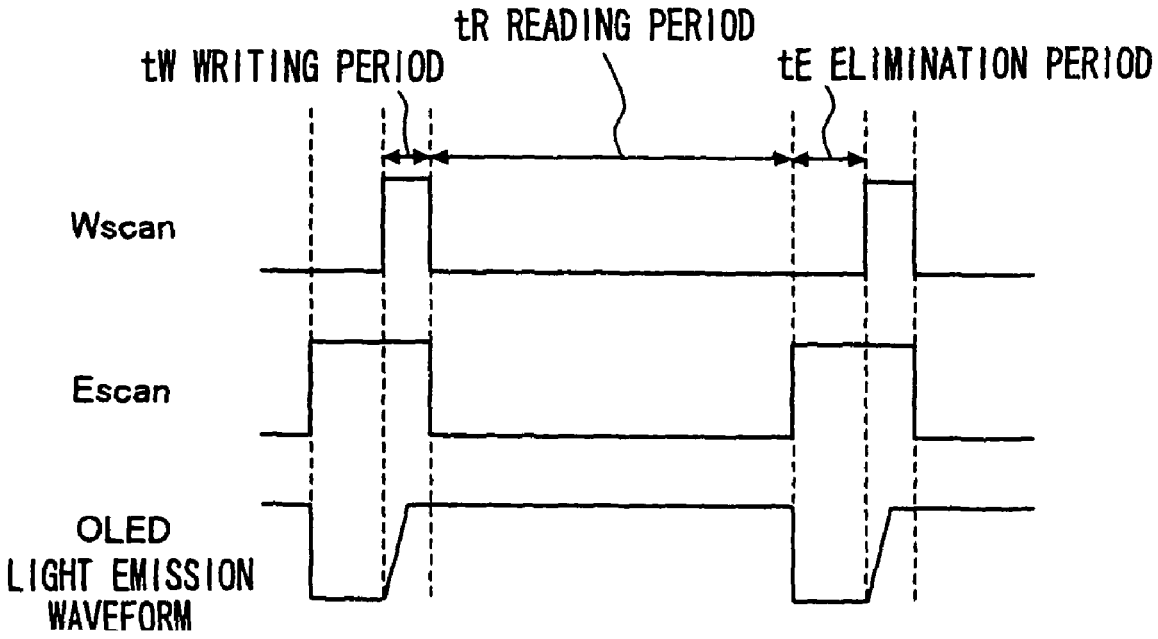
FIG. 7 shows a table and a waveform view illustrating the operation of the display device in an embodiment of the invention.

FIG. 7 shows a table and a waveform view illustrating the operation of the display device of an embodiment of the invention. FIG. 7 focuses on the scanning lines Wscan 1 and Escan, and shows the scanning line level for each of the writing period tW, reading period tR, and elimination period tE and the conductive and non-conductive state of the transistor in the pixel.

Figure 8:
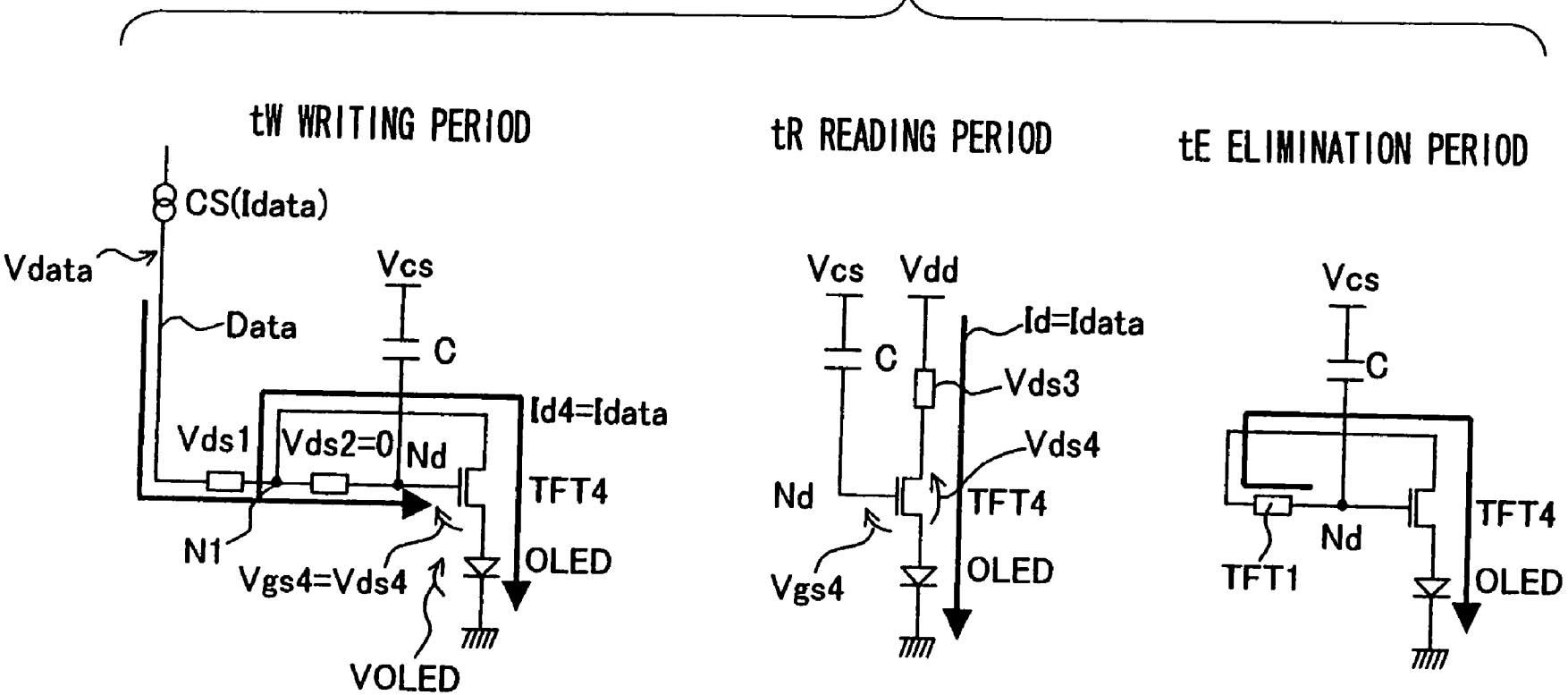
FIG. 8 is a view illustrating the operation of the pixel circuit in an embodiment of the invention.
Figure 9A:
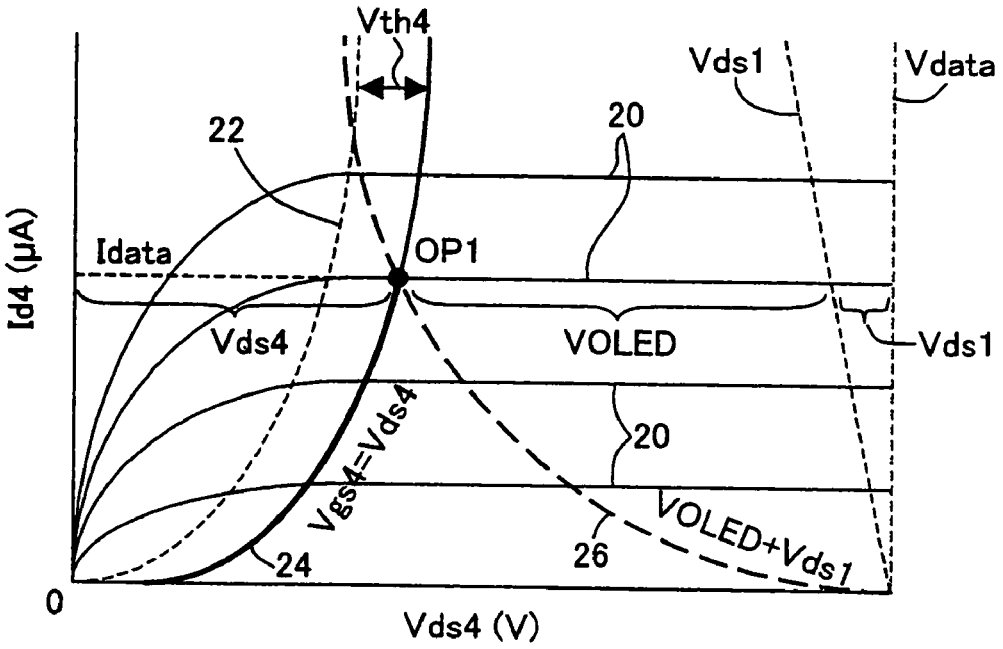
FIG. 9 is an explanatory view showing the operation of the pixel circuit in an embodiment of the invention.
Figure 9B:
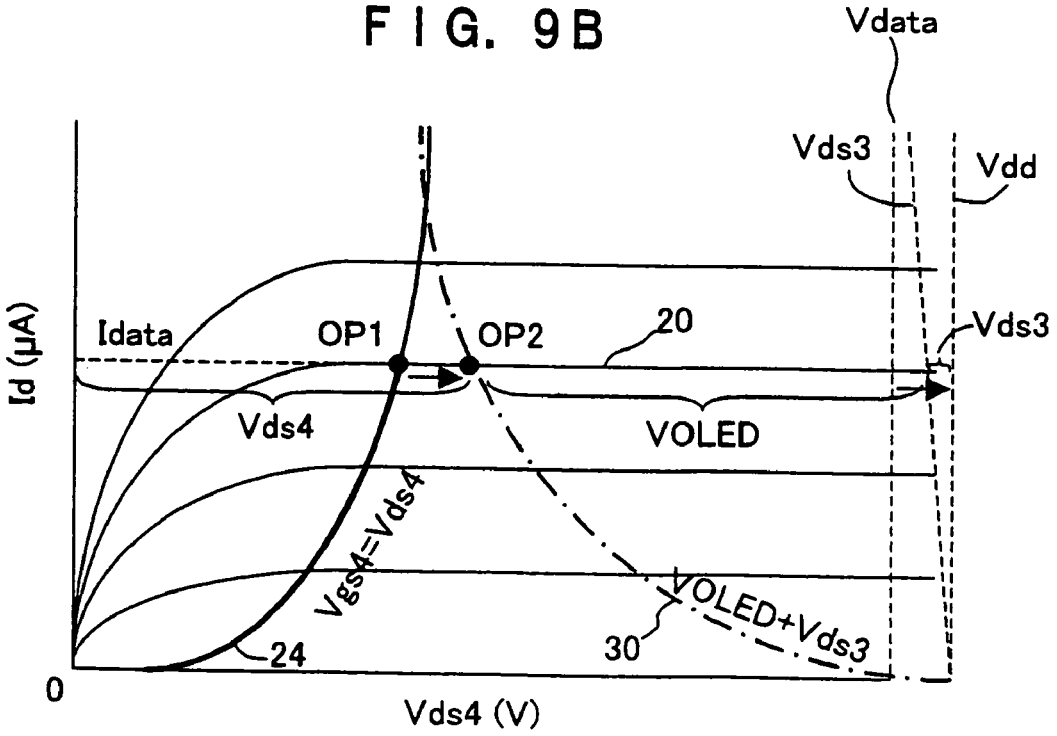

FIG. 8 is a view showing the operation of the pixel circuit of the present embodiment. Corresponding to the table showing the operation in FIG. 7, the connection state and the electric current path are shown for the respective periods (the writing period tW, the reading period tR, and the elimination period tE). Further, FIG. 9 is an explanatory view illustrating the operation of the pixel circuit in the embodiment and describes the operation at the time of writing (FIG. 9A) and at the time of reading (FIG. 9B). In this drawing, the axis of abscissas shows the drain-source voltage Vds4 of the driving transistor TFT4 and the axis of ordinates shows the drain electric current Id4 of the driving transistor TFT4. Hereinafter, with referencing to FIGS. 7, 8, and 9, the operation of the display device of the embodiment of the invention will be described in detail.

[Writing Period]

In the writing period tW, the first and the second scanning lines Wscan and Escan are both at H level and the transistors TFT1 and TFT2 are turned on while the transistor TFT3 is turned off. Consequently, the data line driving circuit 12 supplies the writing electric current Idata corresponding to the brightness information to the respective pixel through the data line. A shown for the writing period tW in FIG. 8 in the equivalent circuit, the electric current source CS supplies the writing electric current Idata to the series circuit comprising the transistor TFT1, the driving transistor TFT4 whose gate-drain is short-circuited by the transistor TFT2 so as to be diode-connected, and the light emitting element OLED. In this case, the important point is that the data line driving circuit 12 generates the writing electric current Idata corresponding to the brightness information in the electric current source CS. That is, it does not matter in which state the circuit to which the writing electric current Idata is supplied is in, the writing electric current does not vary.

In the writing period, the operation point of the circuit to which the writing electric current Idata is supplied is the operation point OP1 shown in FIG. 9(*a*). In FIG. 9(*a*), an operation curve 24 of the drain-source voltage Vds4 is shown in relation to the drain electric current Id4 of the driving transistor TFT4 which is diode-connected. The operation curve 24 is the same as a common diode characteristic. That is, the drain-source voltage Vds4 corresponding to the drain electric current Id4 is generated. Further, FIG. 9(*a*) shows an operation curve 26 of the series circuit of the light emitting element OLED and the first transistor TFT 1 in relation to the supplied writing electric current Idata. The operation curve 26 shows the sum of the source-drain voltage Vds1 of the first transistor TFT1 and the voltage of VOLED of the light emitting element OLED in the opposed direction to the axis of abscissa on the basis of the voltage Vdata of the data line. That is, the driving curve 26 corresponds to the load characteristic of the first transistor TFT1 and the light emitting element OLED.

In the writing period, since the writing electric current Idata flows in the above-mentioned series circuit, the data line potential Vdata is determined such that the load curve 24 of the driving transistor TFT4 and the load curve 26 of the first transistor TFT 1 and the light emitting element OLED intersect at the writing current Idata. That is, corresponding to the data line potential Vdata, the load curve 26 moves right and left. At that time, the potential of the gate Nd of the driving transistor TFT4 is defined as Vdata−(Vds1+Vds2) (wherein, Vds1 and Vds2 respectively denote the drain-source voltages of the first transistor TFT 1 and the second transistor TFT2), and the capacitor C is charged with an electric charge that corresponds to this condition. During the writing period, the writing electric current Idata is supplied to the light emitting element OLED, and correspondingly, the light emitting element OLED emits light.

As described above, the operation point of the series circuit is the point OP1 where the driving curves 24 and 26 intersect each other. That is, since the drain electric current Id4 of the driving transistor TFT4 which is diode-connected is equal to the writing electric current Idata (Id4=Idata), the drain-source voltage Vds4 becomes equal to the drain-source voltage Vds4 of the driving transistor TFT4 at the time when the writing electric current Idata flows as the drain current Ids4. Further, since the gate and the drain of the driving transistor TFT4 are short-circuited, the gate-source voltage Vgs and the drain-source voltage Vds4 (Vds4=Vgs) are equal to each other, and consequently, the gate-source voltage Vgs of the driving transistor TFT4 becomes a voltage that constantly depends on the writing electric current Idata. In other words, the writing in the electric charge to the capacitor C is carried out such that the potential of the node Nd constantly depends on the writing electric current Idata.

Meanwhile, in FIG. 9(*a*), the curve 20 shows the transistor characteristic (I-V characteristic) of the driving transistor TFT4, and the curve 22 corresponds to the boundary of the unsaturated region and the saturated region of the I-V characteristic 20.

[Reading Period]

In the reading period tR, the first and the second scanning lines Wscan and Escan are both at L level and the first and the second transistors TFT1 and TFT2 are both turned off, and the third transistor TFT3 is turned on. As a result, during the reading period, as shown in FIG. 8, the electric power source Vdd, the third transistor TFT3, the driving transistor TFT4, the light emitting element OLED, and the ground GND form a series circuit. Further, the electric charge charged at the capacitor C has no discharge path, and the potential at the gate Nd of the driving transistor TFT4 is maintained.

The driving transistor TFT4 is operated with the I-V characteristic 20 corresponding to the gate-source voltage Vgs which is determined based on the potential of the gate Nd. That is, the driving transistor TFT4 is driven in the saturated region of the I-V characteristic curve 20 shown in FIG. 9B.

Further, since the third transistor TFT3 is turned on so that an electric current is supplied from the electric power source Vdd, the reference voltage for the load curve 30 between the third transistor TFT3 (drain-source voltage Vds3) and the light emitting element OLED (voltage VOLED) is shifted to Vdd from Vdata. As a result, a new operation point is shifted to the intersecting point OP2 of the I-V characteristic 20 of the driving transistor TFT4 and the load curve 30 of the third transistor TFT3 and the light emitting element OLED. The load curve 30 shows the sum of the source-drain voltage Vds3 of the third transistor TFT3 and the voltage of VOLED of the light emitting element OLED in the opposed direction to the axis of abscissa with the voltage Vdd of the electric power source as the base.

Since the new operation point OP2 is on the saturated region of the driving transistor TFT4, the drain electric current Id of the driving transistor TFT4 becomes equal to the electric current of the writing electric current Idata. That is, the light emitting element OLED is driven with the electric current Id equal to the writing electric current Idata and emits light corresponding to the writing electric current Idata. In this way, at the time of writing, corresponding to the diode characteristic of the driving transistor TFT4, the capacitor C is charged at a gate potential corresponding to the writing electric current Idata, and at the time of reading, the light emitting element is driven with the driving electric current Id (=Idata) corresponding to the gate potential. Accordingly, without being affected by the unevenness of transistor characteristic, the light emitting element can be driven with the writing electric current Idata corresponding to the brightness information.

[Elimination Period]

In the elimination period tE, the first scanning line Wscan is at L level and the second scanning line Escan is at H level; the first and the third transistors TFT1 and TFT3 are turned off; and the second transistor TFT2 is turned on. As a result, as shown in FIG. 8, the electric charge stored at the capacitor C is discharged through the first transistor TFT1, the driving transistor TFT4, and the light emitting element OLED. During the discharge, the light emitting element OLED temporarily emits light.

By the elimination operation, the written state in the capacitor C during the frame period is reset, and the light emitting element OLED does not emit light during the non light emitting period tNLE. Thus, in the writing operation in the next frame period, no effect is caused by the writing state during the prior frame period. In other words, as the number of the scanning lines increases in a large scale screen, the scanning period of the respective scanning line is shortened. As a result, if the state of the capacitor C is not reset, in some cases in the writing operation for a short scanning periods after resetting the state of the previous frame period the writing by the writing electric current in the present frame period may not be completed. However, if the above-mentioned elimination operation is done, the capacitor is reset before writing, so that no effect of the hysteresis of the prior frame period is caused and variation of the brightness with the lapse of time can be suppressed.

Further, due to the elimination operation, the light emitting element OLED which emits light during the reading period tR is extinguished once and therefore, in the case of motion display, overlapping of the afterimage of the prior frame on the image in the present frame is prevented and thus motion image deterioration can be prevented. Images which look sharp to the human eye can be displayed.

Further, the elimination operation period can be controlled by controlling the driving pulse width of the second scanning line Escan by the second scanning line driving circuit 15. Accordingly, the brightness of an image can be finely adjusted by adjusting the driving pulse width of the second scanning line. For example, the contrast of image displays with very high brightness can be improved.

[Writing Operation with Different Brightness Information]

Figure 10:
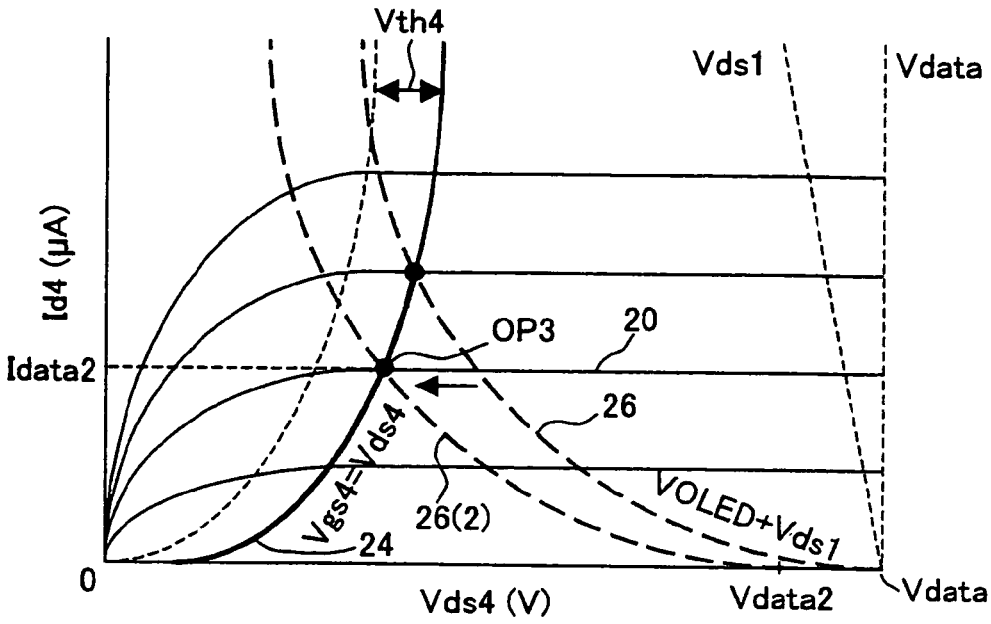
FIG. 10 is an explanatory view of the writing operation of different brightness information in an embodiment of the invention.

FIG. 10 is an explanatory view illustrating the writing operation of different brightness information in an embodiment of the invention. The difference from FIG. 9(*a*) is that the writing electric current Idata2 is decreased. In the case where the writing electric current Idata becomes as low as Idata2 according to the brightness information, the electric current flowing to the circuit of the first transistor TFT 1, the driving transistor TFT4, and the light emitting element OLED is decreased, and the drain-source voltage Vds4 of the diode-connected driving transistor TFT4 and the voltages of the first transistor TFT1 and the light emitting element OLED shift. It follows that, the voltage Vdata2 of the data line is shifted to the left and the load curve 26(2) is also shifted to the left, as shown in FIG. 10. As a result, the intersecting point OP3 between the diode characteristic curve 24 and the load curve 26(2) becomes the new operation point. The operation point OP3 corresponds to the new writing electric current Idata2.

In the reading operation, the operation point is simply shifted along the I-V characteristic 20 on the operation point OP3, and the driving electric current Id4 equal to the writing electric current Idata2 flows to the driving transistor TFT4 so that the light emitting element OLED is driven. That is, the light emitting element OLED emits light with the luminescence corresponding to the writing electric current Idata2.

[Writing Operation in the Case of Variations of Transistor Characteristic]

Figure 11:
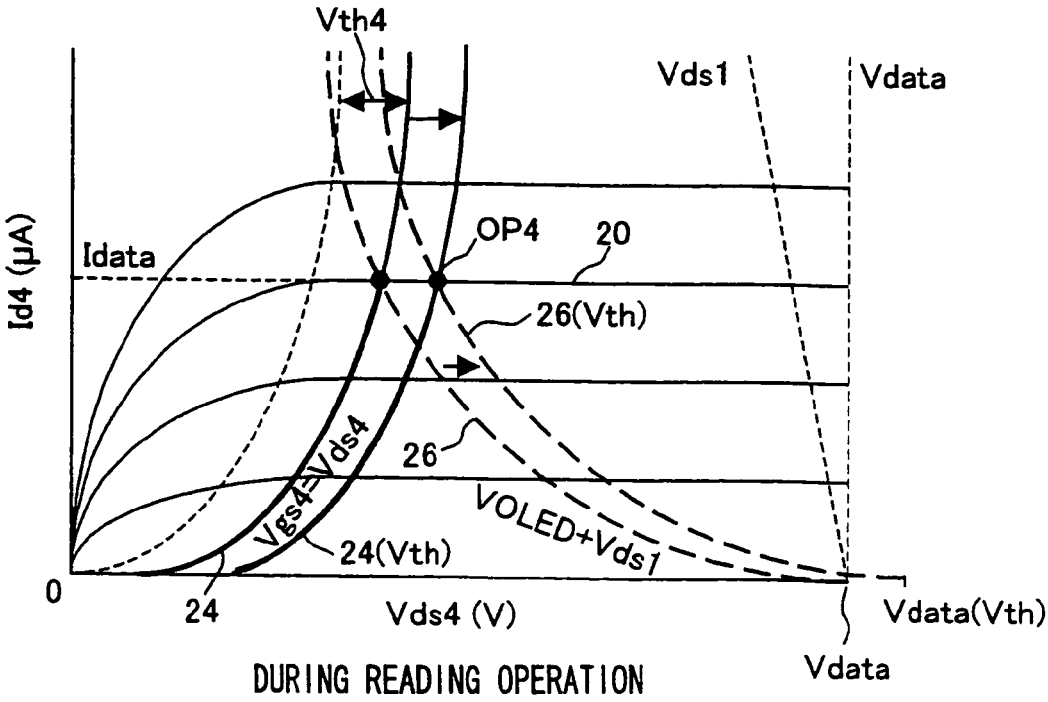
FIG. 11 shows a view showing the writing operation in the case where the properties of transistors are uneven in an embodiment of the invention.

FIG. 11 is a view showing the writing operation in the case where variations in characteristics of the transistors is caused in an embodiment of the invention. FIG. 11 shows a case where the threshold voltage of the driving transistor TFT4 is shifted in the direction in which it becomes higher, and the diode characteristic 24(Vth) is shifted to the right. Along with the increase of the threshold voltage, the voltage Vdata(Vth) needed for the series circuit composed of the first transistor TFT1, the driving transistor TFT4, and the light emitting element OLED is increased as shown in FIG. 11 and the load curve 26(Vth) is shifted to the right. The operation point OP4, which is the intersecting point between the operation curve 24(Vth) and the operation curve 26(Vth), is maintained at the point corresponding to the writing electric current Idata.

In the reading operation, the operation point is simply shifted along the I-V characteristic 20 on the operation point OP4 and the driving electric current equal to the writing electric current Idata flows to the driving transistor TFT4 so that the light emitting element OLED is driven. Thus, even if the characteristics of the transistors vary due to variations in production, the driving electric current of the light emitting element is controlled so as to be equivalent to the writing electric current Idata. That is, an image of luminescence brightness which is independent of the characteristic variations can be obtained.

Looking at it from another perspective, that the transistor is independent of the threshold voltage may be explained as following. As the threshold voltage of the driving transistor TFT4 is increased, the potential of the gate Nd after writing is also increased. However, even if the potential at the gate Nd becomes high due to the high threshold voltage of the driving transistor TFT4, the driving current Id4 is not changed. On the other hand, if the threshold voltage is lowered, the potential at the gate Nd after writing is also lowered. However, even if the potential at the gate Nd is lowered due to the low threshold voltage of the driving transistor TFT4, the driving current Id4 is not changed. That is, since the transistor for determining the potential at the gate Nd at the time of writing and the transistor for determining the driving electric current at the time of reading are the same driving transistor TFT4, no problem associated with variations in characteristics of the in-pixel transistors arise, as arise in the above-mentioned Patent Document No. 2.

Modified Example

Figure 12:
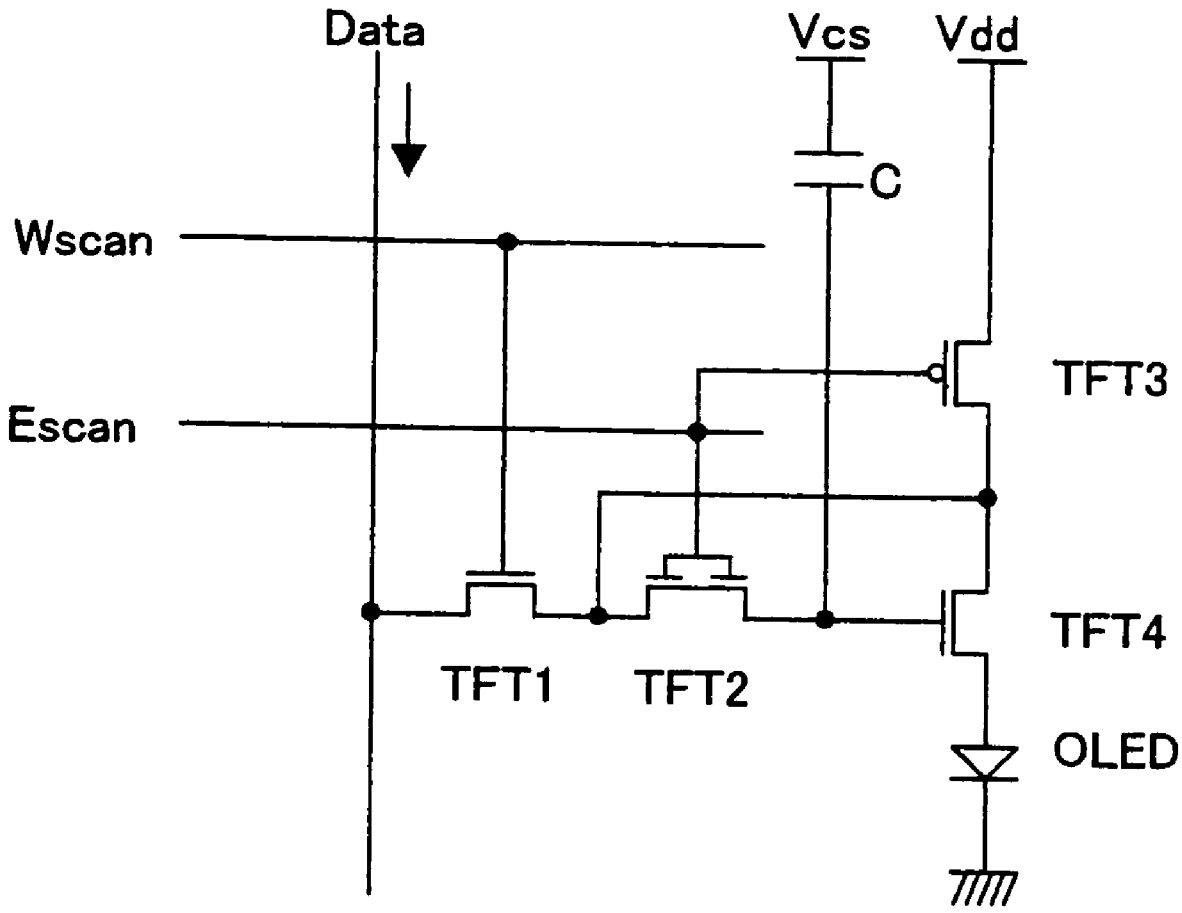
FIG. 12 is a view showing a modified version of pixel circuit in an embodiment of the invention.

FIG. 12 shows a modified example of an embodiment of the invention. The pixel circuit of the modified example uses a MOS transistor having a double gate structure as the second transistor TFT2. The second transistor TFT2 is controlled to be in an off-state in response to the L level of the second scanning line Escan during the reading period and the capacitor C maintains a charged state. Accordingly, occurrence of current leakage from the node Nd, which tends to cause fluctuations of the display brightness, has to be avoided as much as possible. Therefore, in this modified example, two gate electrodes are formed in the second transistor TFT2 and both of these two gate electrodes are connected to the second scanning line Escan. As a result, both of the two gate electrodes are controlled to the L level and the current leakage in the off-state can be suppressed.

INDUSTRIAL AVAILABILITY

According to the invention, it is possible to flow a driving current corresponding to writing electric current Idata from a data line to an electric current driving type light emitting element such as an organic EL element, irrespective of unevenness in characteristics of an active element such as TFT. By arranging a large number of such pixel circuits in a matrix-like form, the respective pixels are enabled to emit light accurately with desired brightness, and thus a high quality active matrix type display device can be provided.

Further, in the invention, the Idata, which is caused to flow in the pixel circuit at the time of writing data, also contributes to light emission of the light emitting element, and thus, the limited light emitting period in a single scanning period can be utilized effectively. Further, by using two scanning line driving circuits, one for writing and one for elimination, it is possible to provide an elimination period of desired length in the single scanning period and to achieve improved sharpness during motion display without there being affects from the hysteresis of the prior frame.

The invention claimed is:

1. A display device comprising:

a plurality of scanning lines arranged in a first direction, which are selected successively;

a plurality of data lines arranged in a direction intersecting the first direction, to which a writing electric current corresponding to brightness information is supplied according to the scanning line selection; and a plurality of pixels, arranged at the intersecting points between the plurality of scanning lines and the plurality of data lines, wherein each of the pixels comprises a light emitting element, a driving transistor for supplying a driving current to the light emitting element, a capacitor connected to a gate of the driving transistor for storing writing data, a first transistor that is turned on during a writing period in which the scanning lines are scanned and connects the data lines and a drain of the driving transistor, a second transistor that is turned on during the writing period and short-circuits the gate-drain of the driving transistor while at the same time supplying the writing electric current supplied from the data lines to the capacitor, and a third transistor that disconnects the drain of the driving transistor and a predetermined electric power source during the writing period;

during the writing period, the writing electric current is supplied to a circuit comprising the first transistor, the driving transistor in which the gate-drain is short-circuited, and the light emitting element, so that the capacitor is charged so as to cause the gate of the driving transistor to have a gate potential corresponding to the writing electric current; and during a reading period after the writing period, the first and second transistors are turned off and the third transistor is turned on so that the driving transistor drives the light emitting element with a driving electric current corresponding to the gate potential.

2. The display device of claim 1, wherein the second transistor is turned on and the third transistor is turned off during an elimination period after the reading period, and the electric charge of the capacitor is discharged to the light emitting element through the driving transistor.

3. The display device of claim 2, further comprising a circuit that controls the elimination period.

4. The display device of claim 1, wherein the light emitting element emits light according to the electric discharge during an elimination period.

5. The display device of claim 1, wherein:

each scanning line comprises a first and a second scanning line; and in each of the pixels, a drain of the first transistor is connected to the data line and a gate thereof is connected to the first scanning line;

a gate of the second transistor is connected to the second scanning line, and a pair of the source-drain of the second transistor are connected to a source of the first transistor and the gate of the driving transistor respectively;

the drain of the driving transistor is connected to the source of the first transistor, the source is connected to the light emitting element;

during the reading period, the drain of the driving transistor is connected to the predetermined electric power source; and a gate of the third transistor is connected to the second scanning line and is turned on when the second scanning line is non-selected.

6. The display device of claim 1, wherein the second transistor comprises a double gate structure comprising two gates, and the two gates are connected to the second scanning line.

* * * * *